US008851613B2

(12) United States Patent
Yokozawa et al.

(10) Patent No.: US 8,851,613 B2
(45) Date of Patent: Oct. 7, 2014

(54) PRINTING APPARATUS AND PRINTING METHOD

(75) Inventors: Taku Yokozawa, Yokohama (JP); Satoshi Hayashi, Yokohama (JP); Masaki Nitta, Yokohama (JP); Yosuke Ishii, Kawasaki (JP); Hiroaki Shirakawa, Kawasaki (JP); Yuhei Oikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 49 days.

(21) Appl. No.: 13/543,600

(22) Filed: Jul. 6, 2012

(65) Prior Publication Data

US 2013/0027455 A1 Jan. 31, 2013

(30) Foreign Application Priority Data

Jul. 29, 2011 (JP) ..... 2011-166763

(51) Int. Cl.

| | |
|---|---|
| ***B41J 29/38*** | (2006.01) |
| ***B41J 2/045*** | (2006.01) |
| ***B41J 2/195*** | (2006.01) |
| ***B41J 11/00*** | (2006.01) |

(52) U.S. Cl.

CPC ..... *B41J 29/38* (2013.01); *B41J 2/0458* (2013.01); *B41J 2/195* (2013.01); *B41J 11/002* (2013.01); *B41J 2/04563* (2013.01); *B41J 2/04515* (2013.01); *B41J 2/04513* (2013.01)

USPC ..... 347/17; 347/5

(58) Field of Classification Search

CPC ..... B41J 2/04515; B41J 2/04563

See application file for complete search history.

(56) References Cited

U.S. PATENT DOCUMENTS

2008/0297552 A1* 12/2008 Yokozawa et al. ..... 347/14

FOREIGN PATENT DOCUMENTS

JP 2009-012462 A 1/2009

* cited by examiner

*Primary Examiner* — Justin Seo

(74) *Attorney, Agent, or Firm* — Canon USA, Inc., IP Division

(57) ABSTRACT

A printing apparatus includes a print unit, an acquisition unit, and a setting unit. The print unit performs printing on a sheet by repeating reciprocating scans of a print head. The acquisition unit acquires information on a temperature of the print head. The setting unit sets a wait time to start a next scan after one scan. The setting unit increases the wait time by a predetermined additional time for each subsequent scan once a value acquired by the acquisition unit exceeds a first threshold, unless the value falls below a second threshold.

11 Claims, 9 Drawing Sheets

PRINTING APPARATUS AND PRINTING METHOD

BACKGROUND OF THE INVENTION

1. Field of the Invention

The present invention relates to a printing apparatus which performs printing by applying ink from a print head to a sheet.

2. Description of the Related Art

Head temperature of an inkjet printing print head increases in continuous use. The discharge characteristics of ink from a nozzle vary as the temperature increases. In serial printing where a print head is reciprocated to form an image, changes of the head temperature during printing are a degrading factor of image quality since there can be portions of different hues and/or densities in an image.

An apparatus discussed in Japanese Patent Application Laid-Open No. 2009-012462 detects a temperature of a print head. According to the detected temperature, the apparatus sets the number of scans in which waiting is performed, and a wait time between a head scan and the next head scan.

According to Japanese Patent Application Laid-Open No. 2009-012462, wait times are distributed among a plurality of scans so that each single wait time does not become long in order to suppress hue and density unevenness in a formed image. However, depending on the duty of an image to print, the head temperature can rise or fall sharply during printing of a single scan.

In such a case, subsequent wait time needs to be re-set. If the wait time before and after re-setting is greatly different, the permeability of ink to a sheet can vary in that area. Accordingly, there still remains the possibility of causing large unevenness in hue and/or density.

SUMMARY OF THE INVENTION

The present invention is directed to providing a method that that can set wait times appropriate to a change in head temperature to suppress the occurrence of image unevenness in serial printing.

According to an aspect of the present invention, a printing apparatus includes a print unit configured to perform printing on a sheet by repeating reciprocating scans of a print head, an acquisition unit configured to acquire information on a temperature of the print head, and a setting unit configured to set a wait time to start a next scan after one scan, wherein the setting unit increases the wait time by a predetermined additional time for each subsequent scan once a value acquired by the acquisition unit exceeds a first threshold, unless the value falls below a second threshold.

According to the present invention, a printing apparatus and a printing method are provided that can set wait times appropriate to a change in head temperature to suppress the occurrence of image unevenness in serial printing.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
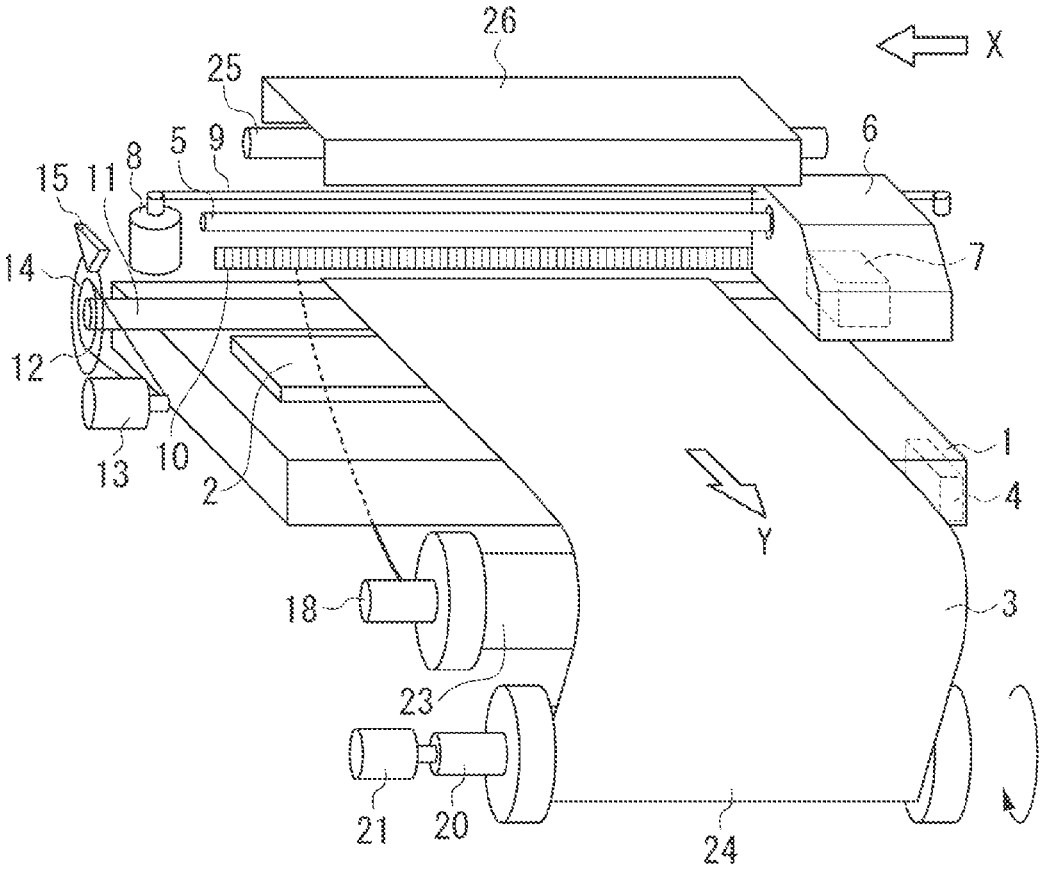
FIG. 1 is a perspective view illustrating the configuration of parts of an inkjet printing apparatus.
Figure 2:
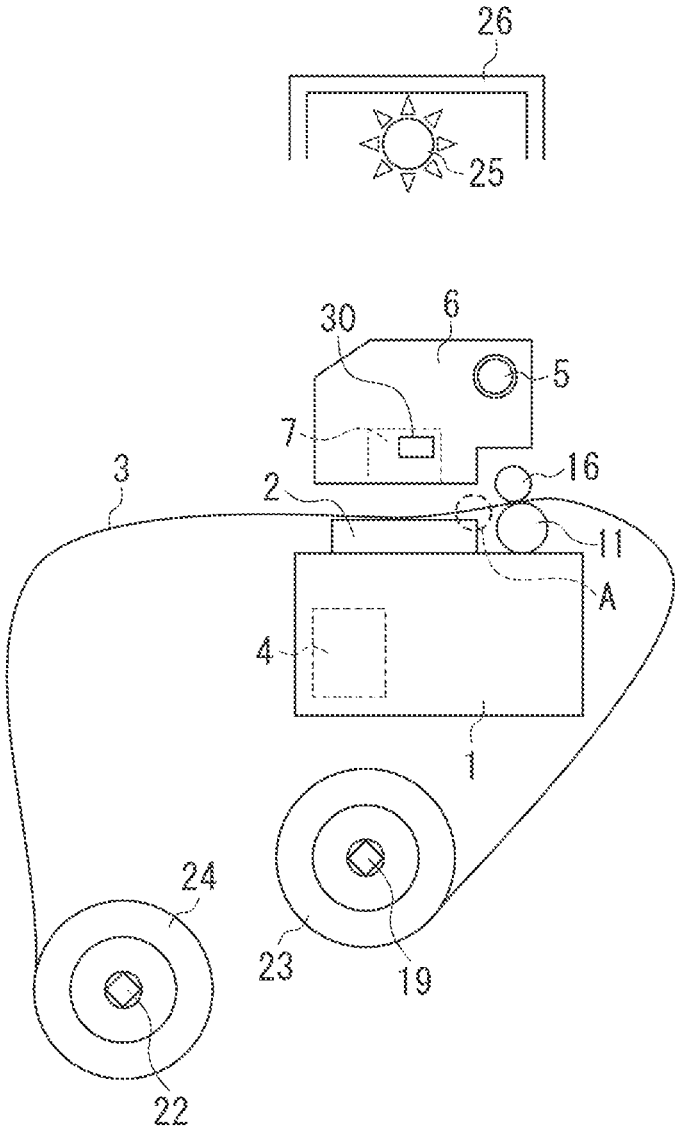
FIG. 2 is a side view illustrating the configuration of parts of the inkjet printing apparatus.

FIG. 1 is a perspective view illustrating the configuration of parts of an inkjet printing apparatus according to an exemplary embodiment. FIG. 2 is a side view of the inkjet printing apparatus. The inkjet printing apparatus, when broadly divided, includes a print unit, a sheet conveyance unit, a dry unit, and a control unit.

The inkjet printing apparatus of the present exemplary embodiment uses a sheet that has no water-repellent receptive layer such as a vinyl chloride layer (hereinafter, referred to as a receptive-layer-less sheet). Ordinary sheets having a receptive layer may also be used. The inkjet printing apparatus according to the present embodiment uses ink that is rich in polymer dispersion (emulsion components). Such ink has a property such that moisture in the ink evaporates and then the emulsion components soften to form a coating when heated on a sheet. The ink coating on a sheet can improve the weather resistance, water resistance, and abrasive resistance of an image.

The print unit forms an image by a so-called serial printing method. The serial printing method includes feeding a sheet 3 onto a platen 2 in a sub scanning direction (Y direction) by step feeding, and scanning a print head 7 over the sheet 3 back and forth in a main scanning direction (X direction) by using a carriage 6.

The platen 2 is mounted on a housing 1. A suction unit 4 for sucking the sheet 3 onto the platen 2 is arranged inside the housing 1. A main rail 5 is arranged along the longitudinal direction of the housing 1. The main rail 5 supports the carriage 6 which reciprocates in the main scanning direction.

The carriage 6 includes the inkjet printing print head 7. Heating elements (electrothermal converters) are used as energy generation elements for discharging ink from nozzles of the print head 7. The print head 7 has a plurality of nozzles for which respective heating elements are provided. The heating elements locally heat ink to cause film boiling, and the ink is discharged from the nozzles by the resulting pressures. The inkjet printing is not limited to that using heating elements and may use other energy generation elements such as piezoelectric elements, electrostatic elements and micro-electromechanical systems (MEMS) elements. The print head 7 includes a temperature sensor 30 (for example, diode sensor) which serves as a detection unit (acquisition unit) for acquiring the temperature of the print head 7.

A carriage motor 8 is a drive source for moving the carriage 6 in the main scanning direction. A belt 9 transmits the rotational driving force of the carriage motor 8 to the carriage 6. The position of the carriage 6 in the main scanning direction is detected and monitored by a linear encoder. The linear encoder includes an encoder pattern 10 of linear shape and a read unit (not illustrated) that optically, magnetically, or mechanically reads the encoder pattern 10. The encoder pattern 10 is attached to the housing 1. The read unit is mounted on the carriage 6. The foregoing is the configuration of the print unit.

The sheet conveyance unit performs sheet handling including sheet feed, sheet conveyance in the print unit, and sheet collection. A long continuous sheet serving as a recording medium is supplied in the form of a roll 23 which is rolled and wound around a spool 18. The spool 18 includes a torque limiter 19 for applying brake force (back tension) to the sheet 3. The sheet 3 is drawn out from the roll 23 and supplied to a lower part of the print unit (housing 1) from the front to back of the inkjet printing apparatus.

The sheet 3 supplied to the lower part of the housing 1 is wound around the housing 1 and supplied to the upper side of the platen 2 from back to front. The sheet 3 is conveyed over the platen 2 in the sub scanning direction (the direction of the arrow Y in FIG. 1) orthogonal to the main scanning direction of the carriage 6. The sheet 3 is conveyed by a drive mechanism including a conveyance roller 11, a pinch roller 16, a belt 12, and a conveyance motor 13. The driving state (the amount of rotation and rotation speed) of the conveyance roller 11 is detected and monitored by a rotary encoder. The rotary encoder includes an encoder pattern 14 of circumferential shape and a read unit 15 that optically, magnetically, or mechanically reads the encoder pattern 14. The encoder pattern 14 rotates with the conveyance roller 11.

The sheet 3 on which an image is printed by the print head 7 of the print unit is wound around and collected on a spool 20. The sheet 3 wound around the spool 20 in a roll shape forms a roll 24. A winding motor 21 rotates the spool 20. The spool 20 includes a torque limiter 22 for applying winding tension to the sheet 3.

The dry unit is a unit for irradiating a sheet, in a case of the receptive-layer-less sheet, with energy for drying ink applied onto the sheet in a short time. The dry unit includes a heater 25. The heater 25 is arranged above (directly above) the platen 2 and above the carriage 6, and includes a heating member that is long in the width direction of the sheet 3. The heater 25 is covered with a heater cover 26. The heater cover 26 has the function of reflecting the heat (infrared rays to far infrared rays) of the heater 25 with a mirror surface inside the heater cover 26 toward the surface of the sheet 3, as well as the function of physically protecting the heater 25.

The heater 25 is located directly above the platen 2. The heater 25 irradiates an area where the print head 7 reciprocates, with thermal energy. When ink discharged from the print head 7 impacts on a print surface, the carriage 6 immediately moves away to expose the applied ink to the thermal energy radiated from the heater 25. This promotes evaporation and drying of moisture in the ink from immediately after printing. The thermal energy of the heat 25 evaporates moisture. The thermal energy also melts a special component in the ink, which covers a color material of the ink. The ink is thus firmly fixed to even a receptive-layer-less sheet, whereby an image having high weather resistance is formed.

The range of irradiation of the thermal energy from the heat 25 in the X direction, is limited to where the sheet 3 is printed. Areas outside the range (both the positions where the reciprocating carriage 6 turns around) are not subjected to the irradiation. During scanning, the carriage 6 and the print head 7 are irradiated with the thermal energy and the print head 7 increases in temperature. In the pausing positions at both ends of the reciprocating scans, the carriage 6 and the print head 7 are not irradiated with the thermal energy and the print head 7 decreases in temperature by natural cooling.

Figure 3:
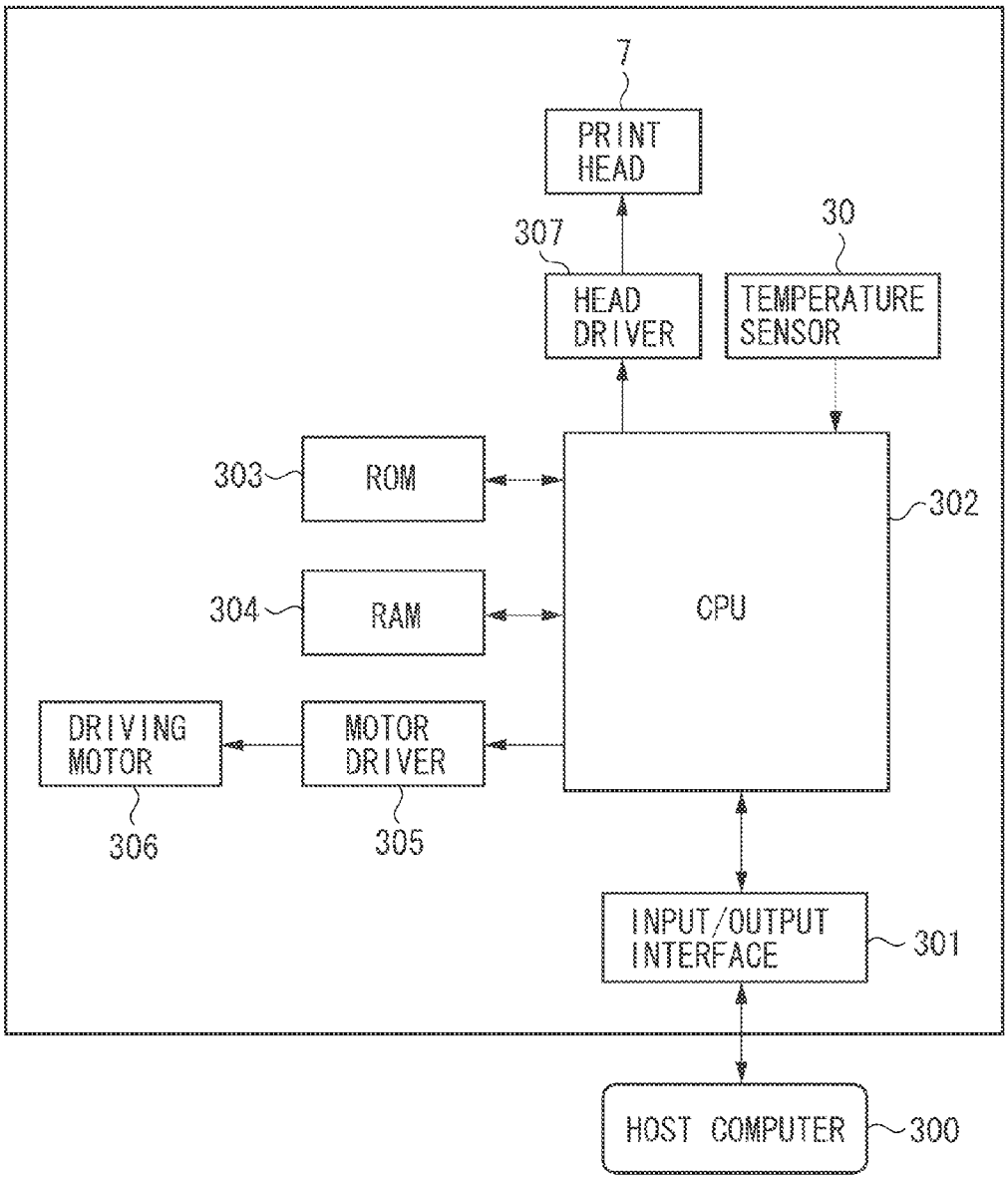
FIG. 3 is a system block diagram of a control unit.

FIG. 3 is a system block diagram of the control unit which controls the printing apparatus. A computer section including a central processing unit (CPU) 302, a read-only memory (ROM) 303, and a random access memory (RAM) 304 constitutes a core of the control unit. An input/output interface 301 connects the CPU 302 with an external host computer 300. The input/output interface 301 allows bidirectional communications based on a predetermined protocol. Under instructions of the CPU 302, a motor driver 305 performs driving control on various types of driving motors 306. Under instructions of the CPU 302, a head driver 307 drives the print head 7. A detection output of the temperature sensor 30 included in the print head 7 is input into the CPU 302.

Now, a problem to be solved by the present exemplary embodiment will be described. Table 1 shows an example of changes of a wait time from the completion of a band scan to the start of the next band scan during repetitive scans (scan 1 to scan 9) of a carriage according to a conventional example like the Japanese Patent Application Laid-Open No. 2009-012462.

TABLE 1

| Head Temperature | Scan 1 | Scan 2 | Scan 3 | Scan 4 | Scan 5 | Scan 6 | Scan 7 | Scan 8 | Scan 9 |
|---|---|---|---|---|---|---|---|---|---|
| 61° C. to 70° C. | 0.2 s | 0.4 s | 0.6 s | 0.4 s | 0.2 s | | | | |
| 70° C. to 80° C. | 0.2 s | 0.4 s | 0.6 s | 0.8 s | 1.0 s | 0.8 s | 0.6 s | 0.4 s | 0.2 s |

Head temperatures detected by a temperature sensor are divided into two temperature ranges by a threshold of 70° C., namely, a first temperature range (61° C. to 70° C.) and a second temperature range (70° C. to 80° C.). Different wait times and different numbers of passes (numbers of scans) to perform waiting are set for the respective ranges. It is not assumed here that the head temperature may shift into another temperature range during the printing with a set number of passes.

However, temperature can change greatly. For example, suppose that the head temperature rises sharply and shifts from the first temperature range to the second temperature range during the fourth scan of printing. In such a case, the wait times and the number of passes need to be switched from the first temperature range to the second temperature range.

In the example of Table 1, the wait time at the fourth scan is set to 0.4 sec. At the fifth scan, the wait time is re-set to 1.0 sec. A time difference between the wait times before and after the re-setting is 1.0-0.4=0.6 sec. Such a large time difference of 0.6 sec exceeds a time difference that is allowable in terms of image unevenness. The resulting image can thus suffer image unevenness such as hue unevenness and density unevenness between scans carried out before and after the re-setting because of different degrees of permeability of ink to a sheet. Specifically, the permeability of the ink applied to the sheet in the preceding band varies depending on the wait time, thereby producing a difference with respect to the permeability of the ink that is applied to the sheet in the following band. If the difference is large, the difference becomes visible to the user as image unevenness between adjoining bands in an image.

In another approach, when the head temperature shifts from the first temperature range to the second temperature range, the number of scans so far may be reset to start reading the data table of the second temperature range from scan 1. The wait time that is set the last (at the fourth scan) in the first temperature range is 0.4 sec. The wait time at the first scan after the resetting is set to 0.2 sec. The time difference between the preceding and following scans falls within an allowable range. However, the wait time is reduced while head temperature is increasing, which degrades the effect of suppressing an excessive temperature increase of the print head.

In the inkjet printing apparatus of the present exemplary embodiment, the inkjet print head 7 uses heating elements. The head temperature is thus likely to increase during print operations. In addition, the dry unit heats the carriage 6 and the print head 7 from above, which further facilitates a temperature increase of the print head 7. For such reasons, wait times for cooling the print head 7 need to be provided between preceding and following scans to optimally manage the wait times.

A basic idea for solving the problem is that once the temperature of the print head 7 detected by the temperature sensor 30 exceeds a first threshold, the wait time is gradually increased by a predetermined additional time for each subsequent scan unless the temperature falls below a second threshold. Once the temperature of the print head 7 detected by the temperature sensor 30 falls below the second threshold, the wait time is gradually decreased by a predetermined subtraction time for each subsequent scan unless the temperature exceeds the first threshold. In other words, the wait time is gradually increased stepwise for each scan while the head temperature remains above the first threshold. This gradually enhances the cooling effect during the waiting. On the other hand, the wait time is gradually decreased stepwise for each scan while the head temperature remains below the second threshold. This gradually suppresses the cooling effect during the waiting. The first threshold and the second threshold may be the same or different. Hereinafter, several exemplary embodiments based on this technical idea will be described.

Figure 4:
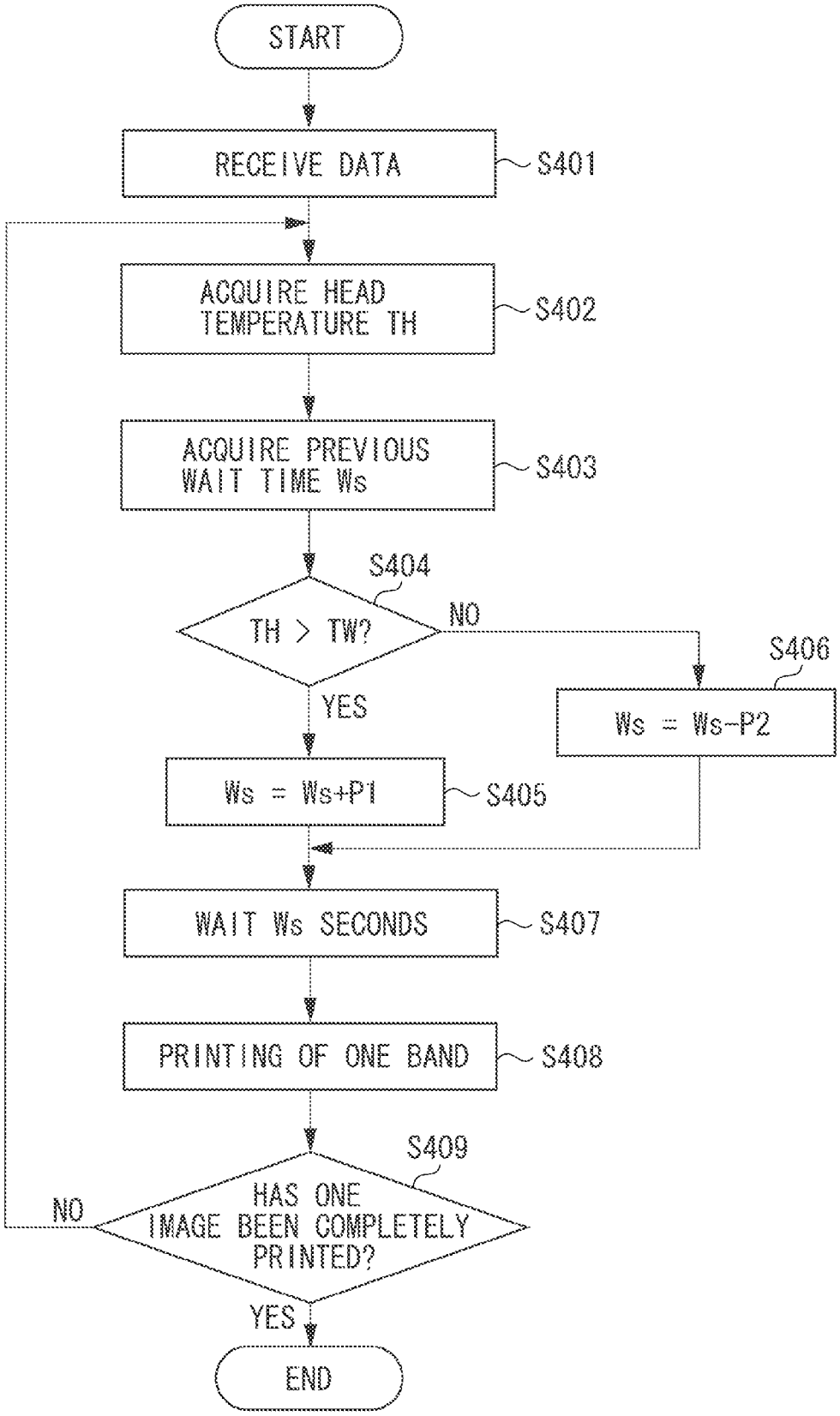
FIG. 4 is a flowchart illustrating a control sequence of a first exemplary embodiment.

A first exemplary embodiment will be described below. FIG. 4 is a flowchart illustrating a control sequence for printing an image. The control sequence is executed based on control of the control unit.

In step S401, the control unit receives image data and various types of control data from the host computer 300. In step S402, the control unit acquires temperature information on the print head 7 (referred to as head temperature TH) detected by the temperature sensor 30.

In step S403, the control unit acquires a wait time Ws that is set in the previous main scan. Since the previous wait time Ws is stored in the RAM 304, the control unit reads the stored value.

In step S404, the control unit compares the head temperature TH acquired in step S402 and a predetermined threshold temperature (referred to as threshold TW) as magnitude relation. In the present example, the threshold TW=65° C. If the head temperature TH exceeds the threshold TW (TH>TW; YES in step S404), the control unit proceeds to step S405. If the head temperature TH does not exceed the threshold TW (TH≤TW; NO in step S404), the control unit proceeds to step S406. Although not shown explicitly in the flowchart, if the head temperature TH coincides with the threshold TW, the control unit proceeds to step S407.

In step S405, the control unit adds a predetermined additional time P1 to the previous wait time Ws, and sets the resultant as the next wait time Ws. The predetermined additional time P1 is a fixed value that will not change during printing of an image (P1=0.2 sec.) In step S406, the control unit subtracts a predetermined subtraction time P2 from the previous wait time Ws, and sets the resultant as the next wait time Ws. The predetermined subtraction time P2 is a fixed value that will not change during printing of an image (P2=0.2 sec.)

In step S407, the control unit performs waiting for a main scan from the completion of the current main scan to the start of the next main scan based on the wait time Ws set in step S405 or S406. During the wait operation, the print head 7 makes no ink discharge operation. The carriage 6 and the print head 7 are not irradiated with heat from the heater 25. The print head 7 therefore decreases in temperature by natural cooling.

After the waiting of step S407, in step S408, the control unit performs a main scan for printing a band (referred to as band scan). The control unit moves the carriage 6 while the print head 7 discharges ink to print a band of image.

In step S409, the control unit determines whether an image has been completely printed. If NO in step S409, the control unit returns to step S402 and repeats the same operations as described above to perform the printing of a band. If YES in step S409, the control unit ends a print operation since all the bands constituting an image have been printed and the image has been completed.

Figure 5A:
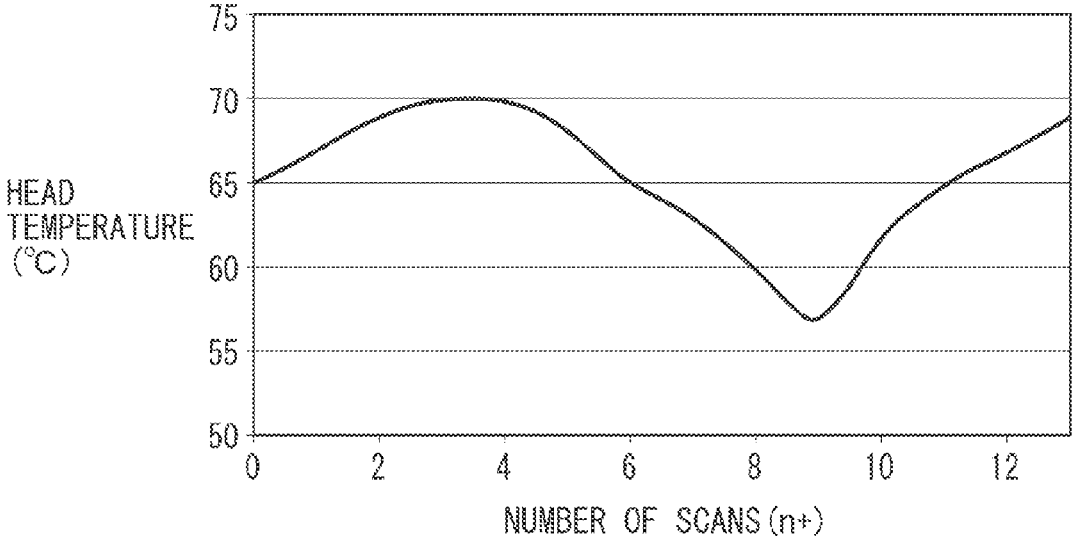
FIGS. 5A and 5B are graphs for describing control, an operation, and effects of the first exemplary embodiment.
Figure 5B:
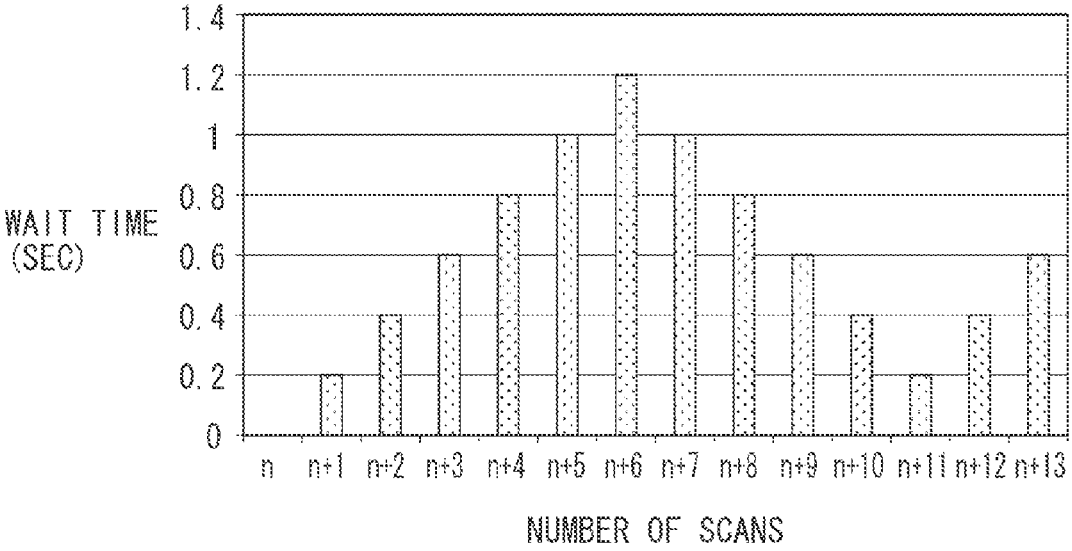

Referring to the graphs of FIGS. 5A and 5B, the control, operation, and effects of the present exemplary embodiment will be described in more detail. FIG. 5A is a graph illustrating an example of changes of the head temperature TH during an operation of printing an image. FIG. 5B is a graph illustrating changes of wait times immediately before the scans of each band when the head temperature TH shifts as illustrated in FIG. 5A.

In the procedure for setting a wait time Ws, the wait time Ws is increased by the predetermined additional time P1 if the detection value of the temperature sensor 30 exceeds the threshold TW, and the wait time Ws is decreased by the predetermined subtraction time P2 if the detection value falls below the threshold TW. If the detection value coincides with the threshold TW, the wait time Ws is kept unchanged.

Time intervals that provide an allowable hue difference and an allowable density difference between adjoining bands formed on a sheet by band scans before and after a wait operation have been experimentally determined. The additional time P1 (0.2 sec) is a constant value that is set not to exceed such time intervals. Similarly, the subtraction time P1 (0.2 sec) is a constant value that is set not to exceed experimentally-determined time intervals that provide an allowable hue difference and an allowable density difference between adjoining bands formed on a sheet by band scans before and after a wait operation. It should be noted that the values 0.2 sec are just an example. The additional time P1 and the subtraction time P2 may have the same values or different values.

The additional time P1 and the subtraction time P2 may be changed according to print conditions such as a print quality setting and the number of passes of multipass printing. In other words, the additional time P1 and the subtraction time P2 may be changed according to the driving load on the print head 7. Further, an upper limit value WI may be changed according to external factors that affect the temperature increase of the print head 7. Examples of the external factors include a temperature setting of the heater 25 of the dry unit and the temperature of the environment where the printing apparatus is placed.

In the example of FIGS. 5A and 5B, the head temperature TH detected by the temperature sensor 30 exceeds the threshold TW (65° C.) at the n-th band scan. Based on such information, the control unit re-sets the wait time Ws immediately before the (n+1)th scan. Since the wait time Ws immediately before the n-th band scan is 0 sec, the wait time Ws immediately before the (n+1)th band scan is set to 0.2 sec which is determined by adding the predetermined additional time P1 (0.2 sec) to 0 sec.

In the subsequent scans, a new wait time Ws is determined by adding the additional time P1 to the previous wait time Ws if the head temperature TH exceeds the threshold TW. As illustrated in FIG. 5B, the wait time Ws thus increases stepwise by the addition of 0.2 sec for each band scan until the (n+6)th. The longer the wait time Ws, the higher the effect of cooling the head temperature TH. In FIG. 5A, the head temperature TH reaches a peak temperature at the (n+4)th band scan before the head temperature TH shifts to decrease. The head temperature TH falls below the threshold TW (65° C.) at the (n+6)th band scan.

When the head temperature TH detected by the temperature sensor 30 falls below the threshold TW, the control unit switches to the processing of decreasing the wait time Ws by the predetermined subtraction time P2. The wait time Ws immediately before starting the next (n+7)th band scan is re-set to 1.0 sec, which is determined by subtracting the predetermined subtraction time P2 (0.2 sec) from the wait time Ws immediately before the (n+6)th band scan, 1.2 sec. Subsequently, the wait time Ws decreases stepwise in units of 0.2 sec as long as the head temperature TH exceeds the threshold TW.

Suppose, for example, that a band of image having high duty (like a solid image having a high density) appears in the process where the wait time Ws continues decreasing. In such a case, the driving load on the print head 7 increases sharply and the head temperature TH rises sharply. In FIG. 5A, the head temperature TH hits the bottom at the (n+9)th band scan. The head temperature TH then shifts to increase, and exceeds the threshold TW at the (n+11)th band scan.

When the head temperature TH exceeds the threshold TW, the control unit switches to the processing of increasing the wait time Ws by the predetermined additional time P1 again. The wait time Ws immediately before the (n+12)th band scan is 0.4 sec, which is determined by adding 0.2 sec to the previous wait time Ws of 0.2 sec. If the head temperature TH detected by the temperature sensor 30 coincides with the threshold TW, the control unit will not change the previous wait time Ws and will set the wait time Ws as the next wait time Ws. Subsequently, similar processing is repeated to carry out printing of a band, thereby completing printing an image.

According to the present exemplary embodiment, the wait time Ws is gradually increased or decreased, whereby the wait time Ws is controlled not to make an abrupt change. Even if the head temperature TH sharply rises or sharply falls during printing, appropriate wait times Ws can be immediately set in response to the temperature change. This can suppress the occurrence of severe hue unevenness and/or density unevenness between adjoining bands, and allows high-quality printing with less image unevenness within a single image. Such an operation and effects become particularly useful in the present exemplary embodiment where an inkjet head including heating elements is used and a carriage and the print head are heated from above by a heater.

A second exemplary embodiment will be described below. The second exemplary embodiment is based on the control processing of the foregoing first exemplary embodiment. The second exemplary embodiment is characterized in that additional values of a wait time have an upper limit.

Figure 6:
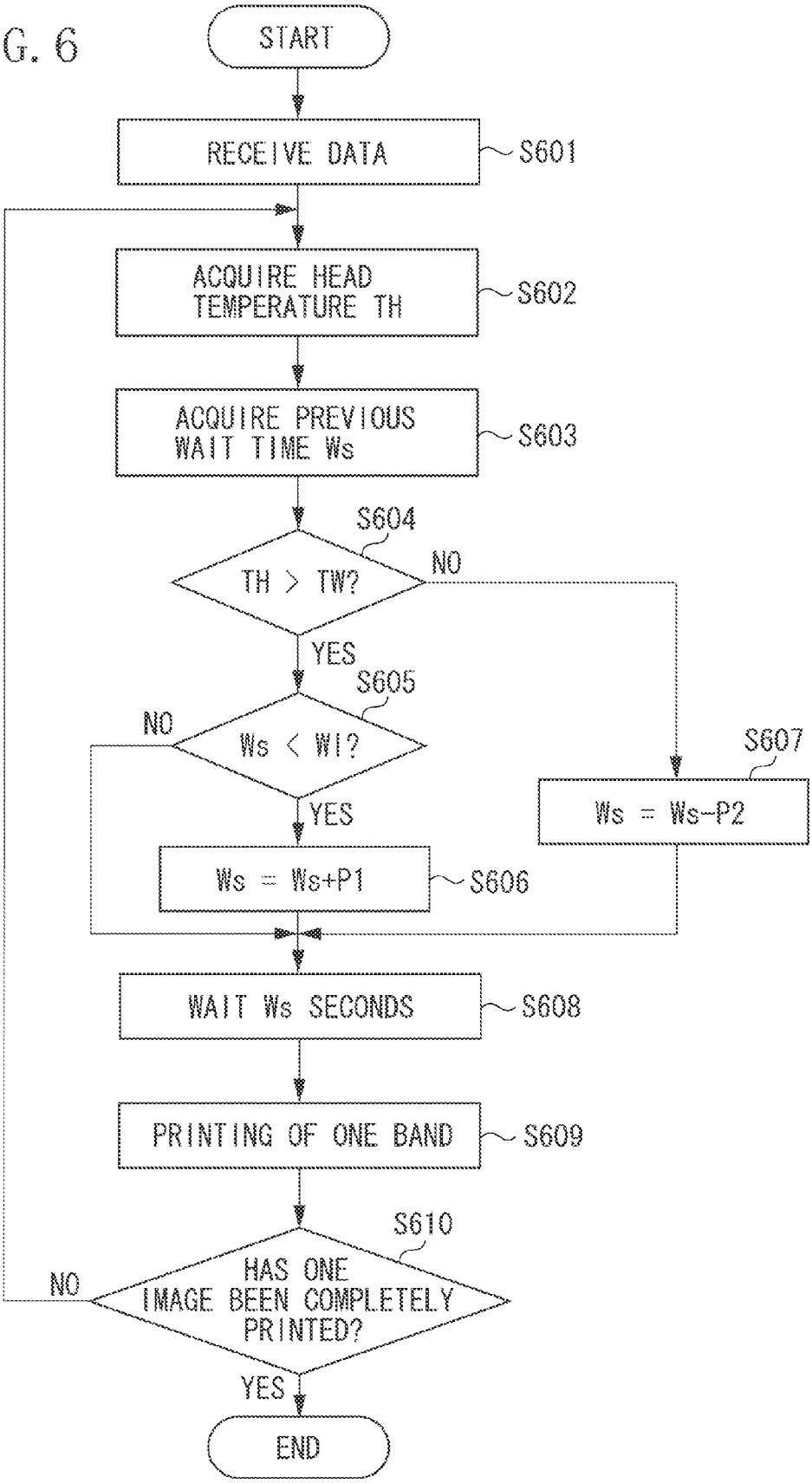
FIG. 6 is a flowchart illustrating a control sequence of a second exemplary embodiment.

FIG. 6 is a flowchart illustrating a control sequence for printing an image according to the second exemplary embodiment. The processing of step S605 is newly inserted. The processing of the other steps S601 to S604 and S606 to S610 is the same as that of steps S401 to S409 in FIG. 4. Description of the similar processing will be omitted.

In step S604, if it is determined that the head temperature TH> the threshold TW (YES in step S604), the control unit proceeds to step S605. In step S605, the control unit compares the previously set wait time Ws and a predetermined upper limit value WI as magnitude relation, and determines whether Ws<WI. If the wait time Ws falls below the upper limit value WI (YES in step S605), the control unit proceeds to step S606. In step S606, like the foregoing processing, the control unit adds the predetermined additional time P1 (0.2 sec) to the wait time Ws and re-sets the resultant as a new wait time Ws. If it is determined in step S605 that Ws≤WI (NO in step S605), the control unit skips the addition processing of step S606 and proceeds to step S608. Although not shown explicitly in the flowchart, in step S5604, if the head temperature TH coincides with the threshold TW, the control unit proceeds to step S608.

Figure 7:
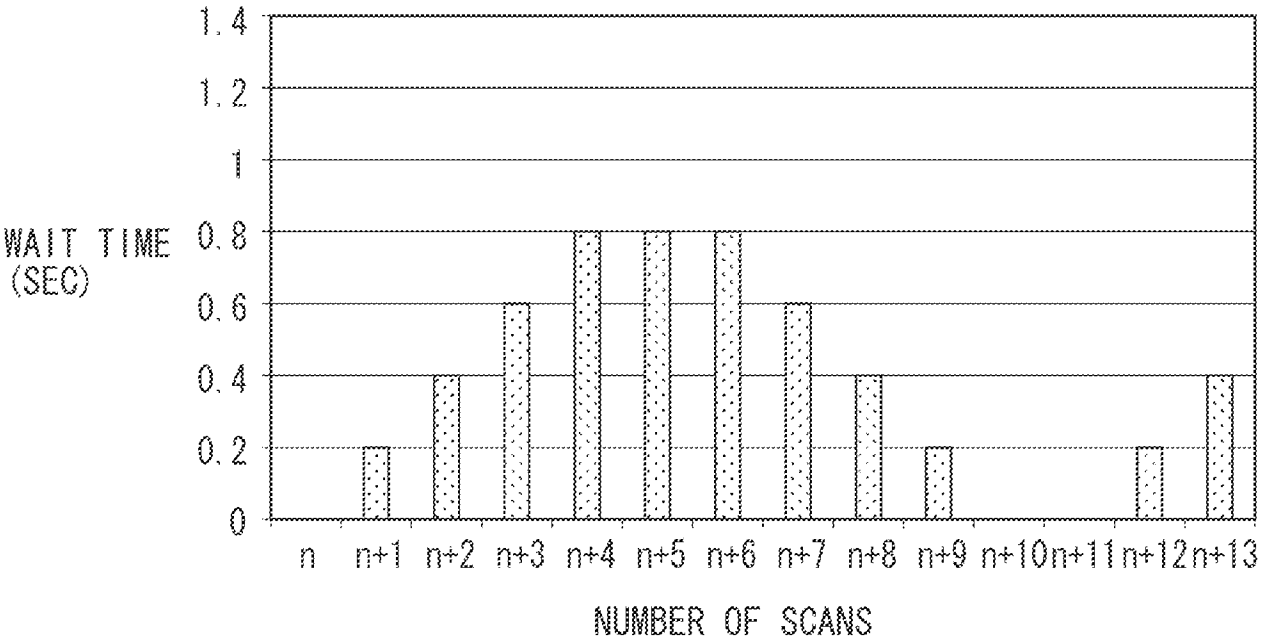
FIG. 7 is a graph for describing control, an operation, and effects of the second exemplary embodiment.

Referring to the graph of FIG. 7, the control, operation, and effects of the present exemplary embodiment will be described in more detail. FIG. 7 is a graph illustrating changes of wait times Ws immediately before the scans of respective bands when the head temperature TH shifts as illustrated in FIG. 5A during printing of an image.

In such an example, the wait time Ws immediately before the (n+4)th band scan reaches the upper limit value WI (0.8 sec). Subsequently, the addition processing on the wait time Ws is not performed and the wait time Ws is controlled to maintain the upper limit value WI even if the head temperature TH exceeds the threshold TW. In other respects, the control is the same as described in the first exemplary embodiment.

It should be noted that the upper limit value WI of 0.8 sec is just an example. The upper limit value WI may have other values. The upper limit value WI is not limited to a constant value, either. The upper limit value WI may be changed according to print conditions such as a print quality setting and the number of passes of multipass printing. In other words, the upper limit value WI may be changed according to the driving load on the print head 7. The upper limit value WI may also be changed according to external factors that affect the temperature increase of the print head 7. Examples of the external factors include a temperature setting of the heater 25 of the dry unit and the temperature of the environment where the printing apparatus is installed.

According to the second exemplary embodiment, in addition to the operation and effects of the foregoing first exemplary embodiment, since an upper limit value WI is provided to a wait time Ws, print throughput is improved when forming an image by repeating main scans.

A third exemplary embodiment will be described below. The third exemplary embodiment is based on the control processing of the foregoing first exemplary embodiment. The third exemplary embodiment is characterized by the provision of two thresholds to be compared with a head temperature TH.

Figure 8:
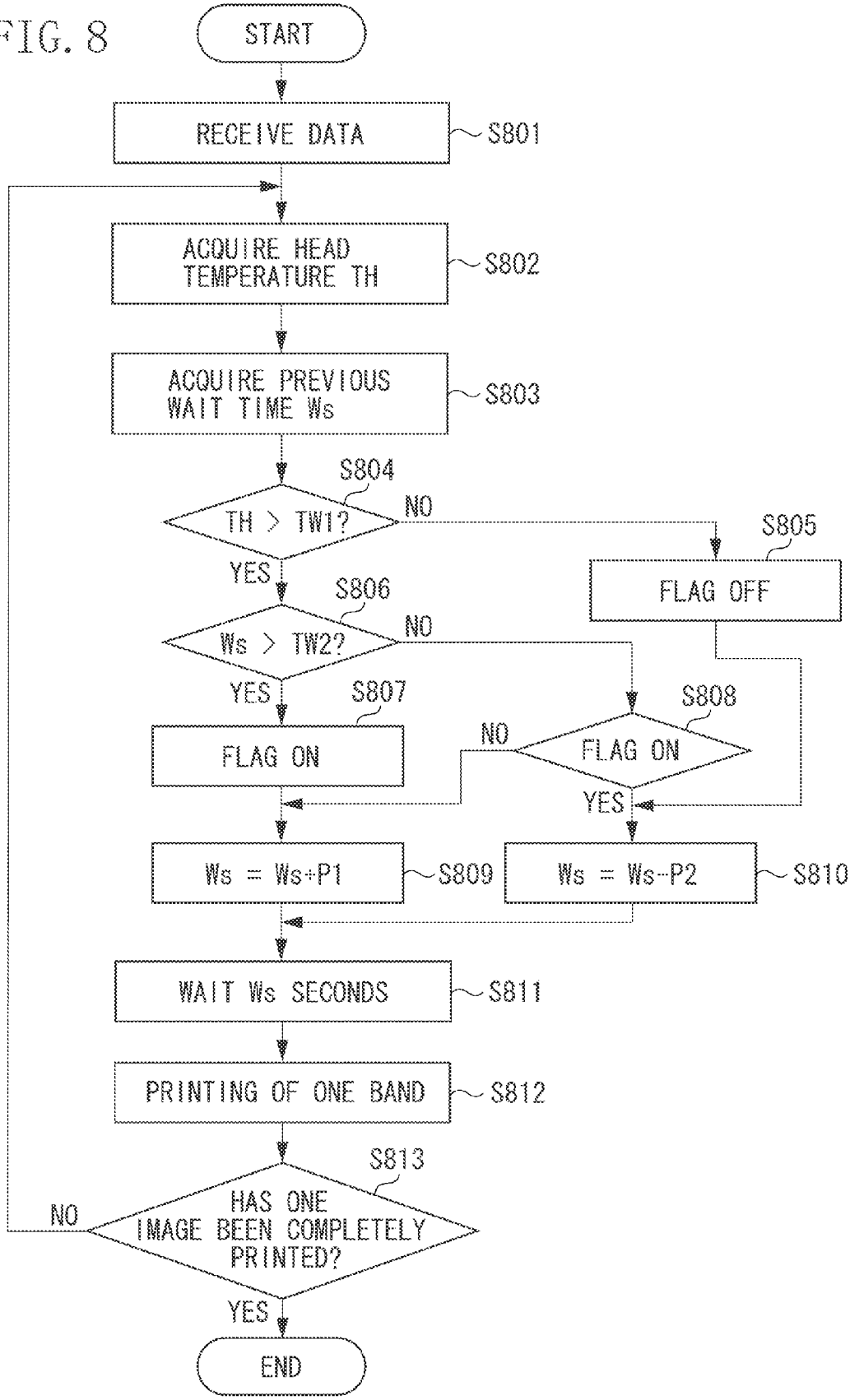
FIG. 8 is a flowchart illustrating a control sequence of a third exemplary embodiment.

FIG. 8 is a flowchart illustrating a control sequence for printing an image according to the third exemplary embodiment. The processing of steps S801 to S803 and S809 to S813 is the same as that of steps S401 to S409 in FIG. 4. Description of the same processing will be omitted.

In step S804, the control unit determines whether the head temperature TH exceeds a first threshold temperature (referred to as threshold TW1) that starts addition of a wait time Ws. If the determination is YES in step S804, the control unit proceeds to step S806. If the determination is NO in step S804, the control unit proceeds to step S805.

In step S806, the control unit determines whether the head temperature TH exceeds a second threshold temperature (referred to as threshold TW2) that starts subtraction of a wait time Ws. A value of the threshold TW2 is greater than the threshold TW1. If the determination is YES in step S806, the control unit proceeds to step S807. If the determination is NO in step S806, the control unit proceeds to step S808.

In step S807, the control unit sets ON a flag that indicates that the head temperature TH exceeds the threshold TW2. The flag provides information for grasping how the head temperature TH changes during printing. In an initial state, the flag is OFF. Once the head temperature TH exceeds the threshold TW2, the flag remains ON unless the head temperature TH falls below the threshold TW1.

In step S808, the control unit switches processing between increase and decrease of the wait time Ws depending on whether the flag is ON or OFF. If the flag is OFF (NO in step S808), the control unit proceeds to step S809 and performs processing of increasing the next wait time Ws by an additional time P1. When the flag is OFF, chances that the head temperature TH rises are considered to be still high. In step S809, the control unit therefore increases the wait time Ws to enhance a cooling rate of the print head 7.

On the other hand, if, in step S808, the flag is determined to be ON (YES in step S808), the control unit proceeds to step S810 and performs processing of decreasing the next wait time Ws by a subtraction time P2. An ON state of the flag indicates the presence of a history that the head temperature TH has exceeded the threshold TW2 which is higher than the threshold TW1. In such a case, the head temperature TH is unlikely to increase further. Since the head temperature TH is possible to be on the decrease, the control unit, in step S810, decreases the wait time Ws to suppress the cooling of the print head 7.

If, in step S804, the head temperature TH is determined to be lower than the threshold TW1 (NO in step S804), then in step S805, the control unit resets the flag OFF. It is because the cooling rate of the head temperature TH need not be enhanced further. After step S805, the control unit proceeds to step S810 and decreases the wait time Ws to suppress the cooling of the print head 7.

Figure 9:
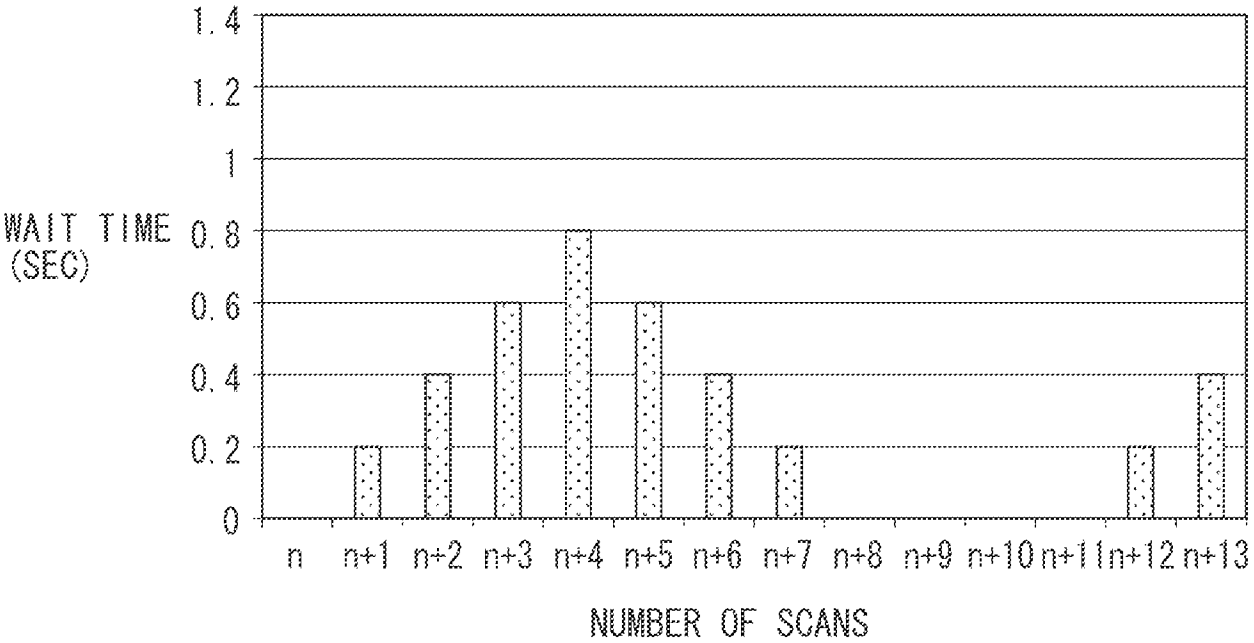
FIG. 9 is a graph for describing control, an operation, and effects of the third exemplary embodiment.

FIG. 9 illustrates wait times Ws between scans when the head temperature TH shifts as illustrated in FIG. 5A. In the present example, the threshold TW1=65° C. and the threshold TW2=70° C.

If the head temperature TH exceeds the threshold TW1 at the n-th band scan and is lower than the threshold TW2, then in step S808, the control unit checks the state of the flag in order to determine whether to increase or decrease the wait time Ws for the (n+1)th band scan. Since the flag in its initial state is OFF, the control unit proceeds to step S809 to increase the wait time Ws by the additional time P1. As a result, while the n-th wait time Ws is 0 sec, the wait time Ws immediately before the (n+1)th band scan is set to 0.2 sec.

Subsequently, the head temperature TH exceeds the second threshold TW2 at the (n+3)th band scan. In step S806, the control unit determines that TH>TW2. In step S807, the control unit sets the flag ON. The control unit then proceeds to step S809, and increases the wait time Ws by the additional time P1 to set the wait time Ws to 0.8 sec.

As a result of the enhanced cooling during the waiting, the head temperature TH decreases slightly and falls below the second threshold TW2 at the next (n+4)th band scan. Note that the head temperature TH is still above the first threshold TW1. In such a case, the control unit makes a determination in step S806 and proceeds to step S808, and makes a determination in step S808 and proceeds to step S810. In step S810, the control unit decrease the wait time Ws from 0.8 sec to 0.6 sec by the subtraction time P2, whereby the cooling is somewhat suppressed. In the subsequent band scans, the flag is maintained ON and the wait time Ws decreases gradually unless the head temperature TH falls below the threshold TW1. If the wait time Ws falls to zero, the wait time Ws of zero is maintained (the (n+8)th to (n+11)th band scans) since it is not possible to reduce the wait time Ws further.

If the head temperature TH falls below the threshold TW1, then in step S805, the control unit resets the flag OFF. When the head temperature TH subsequently exceeds the threshold TW1 again, the flag at the point in time is OFF. As a result, based on a determination in step S808, the control unit proceeds to step S809. Consequently, the wait time Ws gradually increases again after the (n+12)th band scan.

The third exemplary embodiment uses two thresholds, namely, the threshold TW1 for determining whether to increase a wait time Ws (enhance cooling) and the threshold TW2 for determining whether to decrease a wait time Ws (suppress cooling). In addition to the operation and effects of the first exemplary embodiment, the use of the two thresholds TW1 and TW2 enhances responsive performance to changes in the head temperature TH and improves throughput when forming an image.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-166763 filed Jul. 29, 2011, which is hereby incorporated by reference herein in its entirety.

What is claimed is:

1. A printing apparatus comprising:

a print unit configured to perform printing on a sheet by repeating reciprocating scans of a print head;

an acquisition unit configured to acquire information on a temperature of the print head;

a determining unit configured to determine whether a value acquired by the acquisition unit exceeds a threshold; and a setting unit configured to set a wait time to start a next scan after one scan in accordance with a result of the determination by the determining unit, wherein the setting unit increases the wait time by a predetermined additional time before the next scan when the value exceeds the threshold, whereas the setting unit decreases the wait time by a predetermined subtraction time before the next scan when the value does not exceed the threshold.

2. The printing apparatus according to claim 1, wherein both the predetermined additional time and the predetermined subtraction time are fixed values that do not vary during printing of an image.

3. The printing apparatus according to claim 2, wherein the predetermined additional time and the predetermined subtraction time have a same value.

4. The printing apparatus according to claim 1, wherein the setting unit changes the predetermined additional time and the predetermined subtraction time according to at least one of a print condition and an external factor that affects a temperature increase of the print head.

5. The printing apparatus according to claim 4, wherein the print condition includes at least one of a print quality setting and a number of passes of multipass printing, and the external factor includes at least one of a temperature of a heater for heating an area including the print head, and a temperature of an environment where the printing apparatus is installed.

6. The printing apparatus according to claim 1, wherein, in response to the wait time reaching a predetermined upper limit value, the setting unit does not further increase the wait time.

7. The printing apparatus according to claim 1, further comprising a heater configured to irradiate a sheet surface with thermal energy on a side of the sheet surface to be printed, thereby heating an area on the sheet where ink is applied by the print head.

8. The printing apparatus according to claim 7, wherein the heater includes a heating member that is long in a width direction of the sheet and is arranged above the print head within an area where the print head moves.

9. The printing apparatus according to claim 1, wherein the print head is an inkjet printing head that discharges ink by using a heating element.

10. A printing method for performing printing on a sheet by repeating reciprocating scans of a print head, the printing method comprising:

acquiring information on a temperature of the print head;

determining whether an acquired value exceeds a threshold; and setting a wait time to start a next scan after one scan in accordance with a result of the determination, wherein setting includes increasing the wait time by a predetermined additional time before the next scan when the acquired value exceeds the threshold, whereas setting includes decreasing the wait time by a predetermined subtraction time before the next scan when the acquired value does not exceed the threshold.

11. A printing method for performing printing on a sheet by repeating reciprocating scans of a print head, the printing method comprising:

acquiring information on a temperature of the print head; and setting a wait time to start a next scan after one scan, wherein, in response to an acquired value exceeding a threshold, setting includes increasing the wait time by a predetermined additional time before the next scan and, in response to the value falling below the threshold, setting includes decreasing the wait time by a predetermined subtraction time before the next scan.

* * * * *